United States Patent [19]

Honoshowsky

[11] Patent Number: 4,551,990

[45] Date of Patent: Nov. 12, 1985

[54] OIL RETURN APPARATUS FOR A REFRIGERATION SYSTEM

[76] Inventor: John C. Honoshowsky, Rte. 2, Box 361A, Williamsport, Md. 21795

[21] Appl. No.: 661,993

[22] Filed: Oct. 18, 1984

[51] Int. Cl.[4] ..... F25B 43/02

[52] U.S. Cl. ..... 62/468; 62/84; 62/503; 55/410

[58] Field of Search ..... 62/468, 503, 84; 55/410, 416

[56] References Cited

U.S. PATENT DOCUMENTS

| | | | |
|---|---|---|---|
| 1,811,597 | 6/1931 | Steinbart | 55/410 |
| 2,548,335 | 4/1951 | Balogh | 62/503 |
| 3,084,523 | 4/1963 | Bottum et al. | 62/503 |
| 3,257,824 | 6/1966 | Shikasho | 62/468 |
| 3,796,064 | 3/1974 | Ladusaw | 62/503 |

FOREIGN PATENT DOCUMENTS

| | | | |
|---|---|---|---|
| 1257690 | 12/1961 | France | 55/410 |

*Primary Examiner*—Ronald C. Capossela
*Attorney, Agent, or Firm*—Edwin E. Greigg

[57] ABSTRACT

An oil return device for a refrigeration system which is placed in the suction line between the evaporator and the compressor to insure that the lubricant oil in the gases is returned to the compressor to prevent damage to the compressor. The device includes an inner tube within an outer tube each of which are connected to a tee fitting so that fluid flows downwardly between the two tubes and upwardly in the inner tube only. A venturi effect is produced at the end of the inner tube which speeds the fluid sufficiently to carry the oil along with the refrigerant.

4 Claims, 2 Drawing Figures

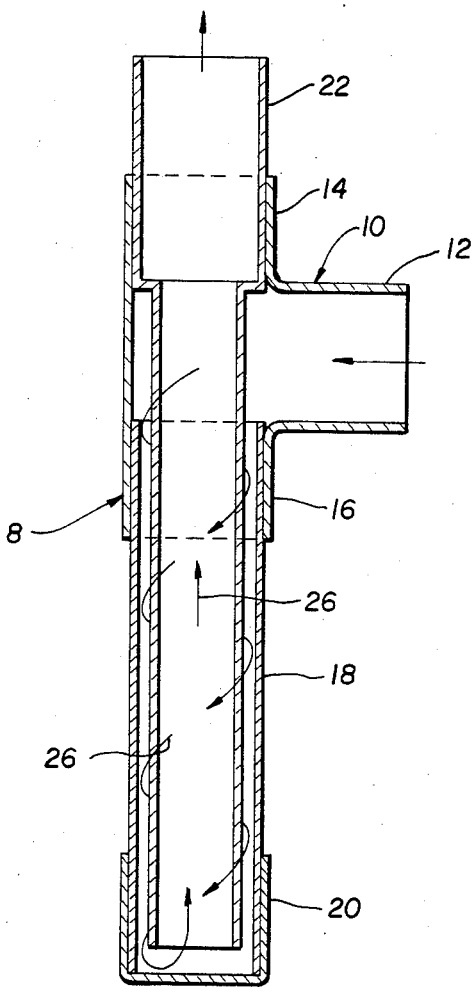
FIG. 1
FIG. 2
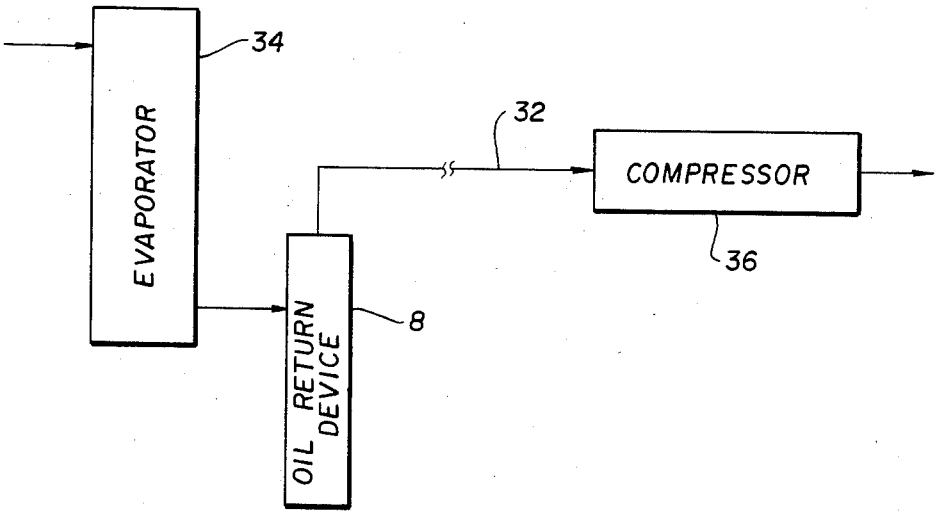

OIL RETURN APPARATUS FOR A REFRIGERATION SYSTEM

BACKGROUND OF THE INVENTION

The invention is directed to an oil return apparatus for a refrigeration system and more particularly to an oil return apparatus which is placed in a return line at the lowest point of the piping between an evaporator and a compressor which prevents oil collection in the evaporator while trapping and returning the oil to the compressor. The apparatus must be placed as close as possible to the evaporator.

The device of this invention may be placed in the suction or return line of a refrigeration system to replace well known traps such as a U-bend in a pipe or other arrangements, one such device being set forth in U.S. Pat. No. 3,257,824.

It is well known in the art that refrigeration systems operating at full capacity have little problems with oil return to the compressor. However, when the compressor is operating at very low capacities, the entrained or occluded lubricant tends to become separated from the gaseous refrigerant settling at low points or at the bottom of riser elements in the system. If the oil settles at risers there is a danger that insufficient oil is returned to the compressor or that gulps of oil will be returned which may damage the compressor. It is therefore desirable that the system be kept free of oil collection areas and that the oil be returned constantly to the compressor without any great buildup at any oil collection areas.

It is well known that in supermarkets as well as other places, the cooling evaporators are from 25 feet to 125 feet from the compressor; therefore, it is very important that the pressure drop be kept at a minimum. For every 90° elbow installed in the suction line, the pressure drop is estimated to be equal to two feet of pipe. Further, supermarket freezers are maintained at about minus 20° using F-502 refrigerant. The back pressure at about minus 20° F. is from 2 to 3 lbs depending upon the length of the pipe. Since temperature equals pressure and the lower the temperature, the lower the pressure. At this pressure, the velocity through any lubricant entrained part must be sufficient to carry the entrained lubricant through the piping to the compressor.

It is therefore an object of the invention to provide a device which will return the lubricant of the system to the compressor without any buildup of lubricant in the device.

Another object of the invention is to provide a device which functions to return lubricant to a compressor without any entrainment of lubricant even at low operating pressure.

BRIEF DESCRIPTION OF THE DRAWINGS

FIG. 1 illustrates a cross-sectional view of the device of this invention along the longitudinal axis.

FIG. 2 illustrates the device in use in a partial, simple system.

DESCRIPTION OF THE PREFERRED EMBODIMENTS

Now referring to the drawing there is shown in FIG. 1 a cross-sectional view of the device along the longitudinal axis of the device. The device 8 includes a tee fitting 10 having an inlet 12 with oppositely disposed legs 14 and 16 to which a downwardly extending tube

18 having the same outer diameter as the inner diameter of the tee fitting legs 14 and 16 is secured to leg 18 thereof along the inner surface of the tee fitting leg 18. A cap 20 having the same inner diameter as the outer diameter of the tube 18 is secured to the outer end of the tube 18 along the outside thereof in order to seal-off the end of the tube 18. An inner tube having a large diameter end 22 with an outer diameter the same as that of the inner diameter of the tee fitting and a smaller diameter end 24 whose outer diameter is smaller than that of the tube 18 is secured by the larger diameter end to the inside of the leg 14 of the tee fitting such that the smaller diameter end 24 extends downwardly through the tee fitting into the larger diameter tube 18 coaxial therewith to provide a spacing between the end of the small diameter end 24 and cap 20. The spacing between the end of tube 24 and the cap 20 being about twice the spacing distance between the small end 24 of the tube and the larger diameter tube 18. The connecting ends of the tubes with the tee fitting and the cap with the tube 18 can be brazed, welded or in any manner secured thereto to prevent any leakage. The device can be made of stainless steel, brass, aluminum, plastic or any other suitable material that will withstand the pressures of the system.

Since the large end 22 of the inner tube is secured to leg 14 of the tee fitting and the end of tube 18 is secured to the leg 16 of the tee fitting, it is obvious that the large end 22 of the inner tube is the same diameter as that of the tube 18. The inner tube 22 and 24 has the same thickness as tube 18 therefore the large end 22 of the inner tube has the same inner and outer diameter as that of tube 18.

In operation of the device, refrigerant and lubricant (fluid) enters the inlet 12 of the tee fitting from the evaporator. Since the large end of the inner tube is sealed within tee fitting leg 14, the fluid must flow downwardly between the outer wall of the small end 24 of the inner tube 24 and that of the inner wall of the outer tube 18. The fluid is stopped by the cap 20 and turns to flow along the inner surface of the small end 24 of the inner tube upwardly through the inner tube and out through the large end 22 of the inner tube as shown by the arrows 26. The large end 22 of the inner tube is connected to the suction line that connects with the compressor. It is seen that since the upper end of the inner tube is sealed at its upper end to the leg of the tee fitting that the fluid must flow by way of the annular passage between the inner and outer tubes down to the cap and then back up through the inner tube. No oil will collect at the cap end because a venturi effect is created between the end of the inner tube and the cap. Therefore, even at low pressure, the venturi effect of the fluid will prevent the oil from separating out from the refrigerant and will be conducted to the compressor.

FIG. 2 illustrates a partial refrigeration system showing the oil return device 8 in the suction line 32 between the evaporator 34 and the compressor 36. It is readily seen that the oil return device has replaced the trap normally used in such a system.

By use of the oil return device, the device can be placed in a horizontal line system. Therefore, there is no requirement that the suction line be in a U-shape such as commonly used. Further, the device is shown in actual size for use in a one inch pipe line. As shown the device is six (6) inches in length with a one inch outside diameter tee fitting which is sufficient for carrying out its intended use.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An oil return apparatus for a refrigeration system comprising:

an outer tubular element closed on one end thereof and open on the other end;

an inlet along the length of said outer tubular element near said open end thereof that forms an open end portion extending from said inlet;

an inner tubular element;

said inner tubular element having a large diameter portion and a small diameter portion;

said large diameter portion of said inner tubular element having an outer diameter substantially the same as the inner diameter of said open end portion of said outer tubular element and secured within said open end portion of said outer tubular element and sealed to the inner surface thereof on the open end side of said inlet with said small diameter portion of said inner tubular element extending along said inlet coaxially within said outer tubular element toward said closed end with a lower end spaced from said closed end of said outer tubular member;

whereby fluid entering said inlet will travel between said outer tubular element and said small diameter portion through the spacing at the closed end and out through said small and larger diameter portions of said inner tubular element.

2. An oil return apparatus as claimed in claim 1 in which:

said outer tubular element is formed by at least two separate pieces.

3. An oil return apparatus as set forth in claim 1, wherein:

said outer tubular element is formed by a tee fitting and an outer tubular element secured to one leg of said tee fitting, said tee fitting forms said inlet and said large diameter portion of said inner tubular element is secured to another leg of said tee fitting.

4. An oil return apparatus as set forth in claim 3 in which:

said closed end of said outer tubular element is closed by a cap secured to one end of said outer tubular element.

* * * * *